US009656106B2

(12) United States Patent
Hollm et al.

(10) Patent No.: US 9,656,106 B2
(45) Date of Patent: May 23, 2017

(54) AIRCRAFT OXYGEN EMERGENCY APPARATUS WITH QUICK RELEASE BOX

(71) Applicant: INTERTECHNIQUE, Plaisir (FR)

(72) Inventors: Marco Hollm, Rosdorf (DE); Hasso Weinmann, Lübeck (DE); Andreas Westphal, Eutin (DE); Wolfgang Rittner, Ahrensbok (DE); Rüdiger Meckes, Berkenthin (DE); Frederik Hoffmann, Stockelsdorf (DE); Romain Ducos, Stockelsdorf (DE); Günter Boomgaarden, Scharbeutz (DE); Benjamin Fleczok, Stockelsdorf (DE)

(73) Assignee: Zodiac Aerotechnics, Plaisir (FR)

( * ) Notice: Subject to any disclaimer, the term of this patent is extended or adjusted under 35 U.S.C. 154(b) by 369 days.

(21) Appl. No.: 13/928,455

(22) Filed: Jun. 27, 2013

(65) Prior Publication Data

US 2015/0000668 A1 Jan. 1, 2015

(51) Int. Cl.

| | |
|---|---|
| ***A62B 18/08*** | (2006.01) |
| ***A62B 25/00*** | (2006.01) |
| ***A62B 7/14*** | (2006.01) |

(52) U.S. Cl.

CPC ..... *A62B 25/005* (2013.01); *A62B 7/14* (2013.01)

(58) Field of Classification Search

CPC ..... A62B 25/005; A62B 7/14; A62B 25/00; E05B 15/0073; E05B 47/0002; E05B 47/0006; E05C 17/56; E05C 19/007; E05C 19/16; Y10T 70/00; Y10T 70/7057; Y10T 70/7062; Y10T 137/8158; Y10T 24/32; Y10T 24/45466; F16K 31/02;

(Continued)

(56) References Cited

U.S. PATENT DOCUMENTS

| | | | | |
|---|---|---|---|---|
| 3,635,511 A | | 1/1972 | Waller | |
| 3,647,165 A | * | 3/1972 | Whitla | A62B 25/005 244/118.5 |
| 3,658,370 A | | 4/1972 | Wang | |

(Continued)

OTHER PUBLICATIONS

Extended European Search Report dated Nov. 21, 2013 in Application No. 13173927.8.

*Primary Examiner* — Bradley Philips
*Assistant Examiner* — Victoria Leszczak
(74) *Attorney, Agent, or Firm* — Kilpatrick Townsend & Stockton LLP; Dean W. Russell; James P. Barker

(57) ABSTRACT

The invention relates to an emergency oxygen supply device for aircraft inhabitants, comprising a container, wherein an oxygen mask is positioned inside said container, a releasable cover and a latch mechanism comprising a latch locking said cover lid. According to the invention said latch mechanism comprises a permanent magnet interacting with a magnetisable element an exerting a magnetic holding force onto said magnetisable element to hold said latch in a locking position, wherein a solenoid is positioned adjacent to the permanent magnet, said solenoid being connected to a control unit said control unit being adapted to receive an opening signal and to provide a current flowing through said solenoid in response to such opening signal, wherein said solenoid is arranged and dimensioned such that the current flowing through said solenoid reduces said magnetic holding force to such a level that the latch is released in a n unlocking position.

11 Claims, 4 Drawing Sheets

(58) Field of Classification Search
CPC ..... F16K 31/08; F16K 31/082; H01F 7/04; H01F 7/06; H01H 9/20
USPC ..... 128/204.29, 205.25, 206.27; 292/251.25; 244/118.5
See application file for complete search history.

(56) References Cited

U.S. PATENT DOCUMENTS

| | | | | |
|---|---|---|---|---|
| 4,111,473 | A * | 9/1978 | Bourrie | E05B 47/00 292/126 |
| 4,428,607 | A | 1/1984 | Levine | |
| 5,244,239 | A | 9/1993 | Wang | |
| 5,253,907 | A | 10/1993 | Schnoor et al. | |
| 5,865,483 | A * | 2/1999 | Dubravin | 292/251.5 |

* cited by examiner

AIRCRAFT OXYGEN EMERGENCY APPARATUS WITH QUICK RELEASE BOX

FIELD OF THE INVENTION

The invention relates to an emergency oxygen supply device for aircraft inhabitants, comprising an oxygen source, an oxygen mask connected via an oxygen line to said oxygen source, a container, wherein said oxygen mask is positioned inside said container, a releasable cover lid mounted to the container to close an opening of said container in a first position of said cover lid and to open said opening in a second position, a latch mechanism mounted to said container, said latch mechanism comprising a latch which is switchable from a first position wherein said latch holds said cover lid in the closed position to a second position wherein said latch gives free the cover lid to move into the open position.

BACKGROUND OF THE INVENTION

Emergency oxygen supply devices are required and prescribed for any aircraft used to transport passengers in high altitudes to allow supply of oxygen to a passenger in a decompression situation. Usually, such emergency oxygen devices comprise an oxygen source like a chemical oxygen generator or a pressurized oxygen tank which is coupled to a single or a plurality of oxygen masks via a valve controlled by a control unit.

In regular flight condition the oxygen masks usually are stored above the passenger in a ceiling compartment. This ceiling compartment may be the container explained beforehand or may be adapted to take up a separate container wherein the oxygen masks are stored. In case of an emergency situation a cover lid of said container opens and the oxygen masks drop out of the container and are provided to the passenger. The oxygen masks stay connected with the oxygen source inside said container via a flexible hose or tube or the like supplying the oxygen from said oxygen source to the oxygen masks or by an additional line or tether holding the oxygen masks at a predetermined level below the container. This allows easy grasping of the oxygen mask by the passenger in an emergency situation.

A general problem with such emergency oxygen supply devices is a safe release of the oxygen masks out of the container in an emergency situation. A plurality of adverse effects may occur in an emergency situation which may hinder such safe release. For example, heat or vibration may be present in the cabin and may thus influence a mechanical interaction of the cover lid with the latch mechanism. It is a first aspect of the invention to provide an emergency oxygen supply device which improves the safety and reliability of the release of the oxygen masks out of the container.

A further problem associated with the safe release is the aspect of energy supply in an emergency situation. Whereas on board of an aircraft a number of redundant energy sources are present to ensure a certain level of supply of energy even in emergency situations it is desired to reduce the consumption of such energy in an emergency situation to a minimum to not endanger important flight control functionality of the aircraft out of said energy sources. It is a further desire to reduce the overall energy consumption of peripheral devices on board of the aircraft in regular flight conditions, too. A second aspect of the invention is to provide an emergency oxygen supply device which provides a safe release of the oxygen masks under reduced energy consumption in regular flight conditions and in an emergency situation.

SUMMARY OF THE INVENTION

According to the invention, an emergency oxygen supply device according to the introductory portion is provided, wherein said latch mechanism comprises a permanent magnet interacting with a magnetisable element and exerting a magnetic holding force onto said magnetisable element to hold said latch in the first position, wherein a solenoid is positioned adjacent to the permanent magnet, said solenoid being connected to a control unit said control unit being adapted to receive an opening signal and to provide a current flowing through said solenoid in response to such opening signal, wherein said solenoid is arranged and dimensioned such that the current flowing through said solenoid reduces said magnetic holding force to such a level that the latch is released in the second position.

The latch mechanism according to the invention comprises a permanent magnet holding the latch in the first position, i.e. the position blocking the cover lid in the closed position. By using a permanent magnet the latch mechanism does not consume any energy in this closed position and thus is optimized for regular flight conditions with regard to energy consumption.

In an emergency situation a solenoid which is arranged adjacent to the permanent magnet, e.g. wound around the permanent magnet, is supplied with current. By this, the holding force of the permanent magnet is reduced or even eliminated and thus the latch is not fixed in the first position anymore. The current supplied to the solenoid can be rather low and short since it is only required to reduce the holding force to a level wherein the latch moves out of the first towards the second position to allow the cover lid to open. A main advantage of the design according to the invention is the option to preload the latch with a significant force which forces the latch from the first to the second position. This preload may be effected by the weight of the cover lid and the oxygen masks lying on the cover lid onto the latch. This force is compensated and countered by the holding force of the permanent magnet. By providing such preload a rather small current is required to reduce the holding force to such a level that the latch moves from the first position to the second position. As soon as the latch has moved a small distance out of the first position the holding force of the permanent magnet is reduced significantly due to the correlation between magnetic force and distance from the permanent magnet.

It is preferred that the magnetisable element is in direct contact to the permanent magnet in the first position of the latch to maximize the holding force at this zero distance between the magnetisable element and the permanent magnet. In such case, the holding force of the permanent magnet is reduced significantly in the small first distance of travel of the latch from the first to the second position and thus a small and short peak current is required for releasing the oxygen masks only.

According to a first preferred embodiment said permanent magnet and said solenoid is fixed to a wall of said container and said magnetisable element is fixed to said latch. This arrangement allows to design the latch with a low weight and mass inertia and to thus facilitate quick release of the latch by its movement.

It is further preferred that said latch is mounted swivable to said container. This swivable mounting of the latch to the container is to be understood as a mounting of the latch to the container lid or to a wall of said container which is adapted to be mounted immovable to a ceiling compartment of an aircraft. The swivable mounting may be achieved by a bearing, a joint or the like defining a geometrical axis of the swivel movement by a design element like an axis or a shaft. Further, the swivel mounting of the latch may be accomplished by an elastic mounting wherein a deformation of the latch or a mounting component of said latch allows the swivel movement. In such elastic swivel mounting no specific component defining an axis may be present but the swivel movement is provided by a reversible elastic deformation of a smaller or larger region of the latch or the mounting component.

It is to be understood that the latch may be dimensioned and designed in such a way that instead of a swivel movement a translational movement between the first and the second position or any other geometrical may be present.

According to a further preferred embodiment said latch comprises a recess or a projection interacting with a section of the cover lid in the closed position to hold said cover lid in the closed position, said recess or projection being positioned such that an opening force is applied to said latch forcing said latch into the second position by the force of gravity exerted by the cover lid onto said latch in the closed position, wherein said holding force holds the latch in said first position against said force of gravity. This preferred embodiment may preferably be used to allow closing of the cover lid if the latch is in the first position wherein said latch then holds the cover lid in the closed position after moving the cover lid from the opened to the closed position. Further, the latch may be designed in such a way that it cannot be reached from outside the container to make sure that no unintended release of the latch takes place or the releasing of the latch may be hindered by any components delimiting the movement of the latch from outside.

It is further preferred that said latch comprises a lever and said magnetisable element is mounted to said lever. Such a lever is to be understood as a separate element or an integral part of the latch extending from a real or virtual axis defining a pivot movement of the latch including the lever. The lever allows to safely hold the latch in the first position and to define a distinct holding and releasing force to provide safe release of the cover lid in an emergency situation.

It is further preferred that said latch mechanism comprises a spring exerting a spring force onto said lever forcing said lever into the second position, wherein said holding force holds the latch in said first position against said spring force. By providing such a spring the movement of the latch from the first into the second position is supported facilitating a safe release of the latch in an emergency situation even under conditions like heavy vibration or deformation as a consequence of heat or impact. The spring may be a spiral spring, a coil spring, a helical spring or any other type of spring like e.g. a deformable elastic element made of a polymeric or elastomeric material or the like. Said spring may preferably act onto a lever as explained in the embodiment beforehand.

It is further preferred that the oxygen supply device according to the invention further comprises a switch which is actuated by the cover lid in the open position or the latch in the second position, wherein said switch interrupts the current flow through said solenoid if said switch is actuated. Such a switch will ensure that the current flowing through the solenoid is only activated for a short-time interval and thus significantly reduces the energy consumption of the oxygen supply device in an emergency situation. The switch may preferably be positioned in such a way that it interrupts the current flow through the solenoid as soon as the latch has reached a position in distance to the first position wherein said distance between the magnetisable element and the permanent magnet is sufficient to allow the latch to further move into the second position even if the magnetic force of the permanent magnet is fully present after again the solenoid is no longer supplied with current. This will further reduce the time interval of current supply to the solenoid and thus will help reducing the energy consumption in an emergency situation.

A further aspect of the invention is a method of providing oxygen to passenger of an aircraft comprising the steps: storing oxygen masks in a container above the passenger seat, said container comprising a cover lid holding said oxygen mask in said container in a closed position, wherein said cover lid is hold in said closed position by a latch in a first position, releasing said oxygen mask out of said container by moving said latch in a second position, wherein said cover lid is no longer held in the closed position and moves into an open position wherein said latch is hold in said first position by holding force exerted by a permanent magnet to a magnetisable element mounted to said latch and said latch is moved into the second position by supplying a current to a solenoid and thereby reducing or eliminating the holding force of said permanent This method is particularly preferred to be conducted using an oxygen supply device as explained beforehand and is directly related to the design of such oxygen supply device according to the invention. It is to be understood that the specific details and functionalities of this method are directly related to the details and functionality of the oxygen supply device explained beforehand and so far reference is made to this part of the description. Further, it is to be understood that the method may be further improved by method steps corresponding to the functional properties of the oxygen supply device explained beforehand as preferred embodiments of said device.

BRIEF DESCRIPTION OF THE DRAWINGS

A preferred embodiment of the invention is explained below with reference to the figures. In the figures.

DETAILED DESCRIPTION OF THE DRAWINGS

Figure 1:
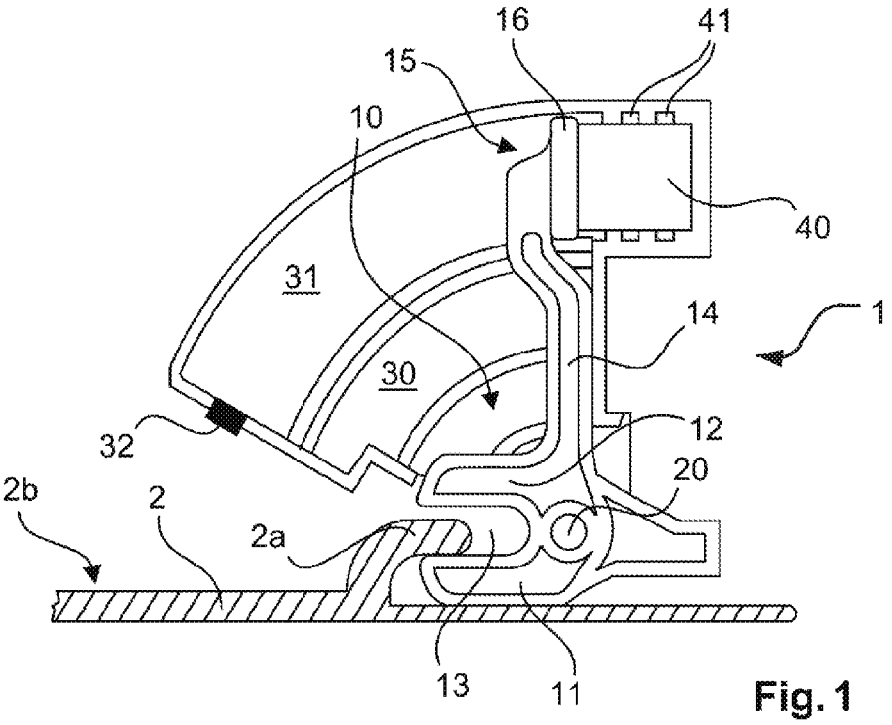
FIG. 1 shows a schematical side view of a first embodiment of the invention in a closed position of a cover lid.
Figure 2:
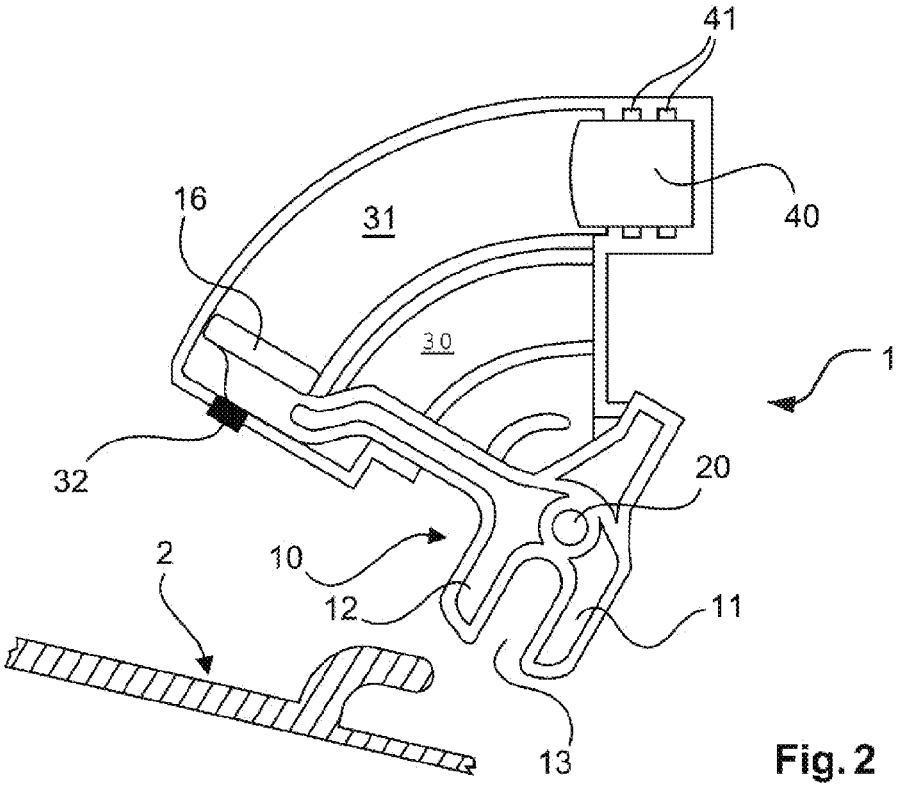
FIG. 2 shows a view according to FIG. 1 of the same embodiment in an opened condition.

Referring first to FIGS. 1 and 2 a latch mechanism 1 is shown which interacts with a cover lid 2.

The latch mechanism 1 comprises a latch 10 which is pivoted around an axis 20. The latch 10 comprises a locking element with two legs 11, 12 which delimit a recess 13. Further, a lever 14 is part of the latch and integral with the legs 11, 12. The lever 14 extends in a perpendicular direction in relation to the legs 11, 12.

The lever 14 extends from the axis 20 to an outer end 15. A metal plate 16 is attached to said end 15 of the lever, said metal plate 16 having a cylindrical shape.

As can be seen in comparison to FIGS. 1 and 2, the metal plate 16 can move on a curved path in a groove 31 which is part of a frame 30 to which the axis 20 is attached.

A permanent magnet 40 is attached to the frame 30 by an insert moulding process and thereby fixed in the frame 30. Said permanent magnet 40 interacts with the metal plate 16 of the lever 14. In a first locking position of the latch 10 the metal plate 16 is in direct contact with said permanent magnet 40 and is held in position by a holding force applied by said permanent magnet on said metal plate 16. It is to be understood that said metal plate is made from a magnetisable metal.

A solenoid 41 is wound around the permanent magnet 40 and held in place by insert moulding inside said frame 30. Said solenoid is connected to a control unit (not shown) via wires allowing to supply a current to said solenoid under the control of said control unit.

The cover lid comprises a projection 2*a* which is locked in a form locking interaction, i.e. a mechanical interaction between the projection 2*a* and the latch 10, in the recess between the legs 11, 12 of the latch 10. This locking condition is shown in FIG. 1, and corresponds to a blocking position of the latch 10 and lever 14. In this figure, the cover lid 2 is held in the closed position.

If the solenoid 41 is supplied with current the magnetic field of the permanent magnet is reduced or eliminated and thus the holding force between the permanent magnet 40 and the metal plate 16 is reduced. The weight of the cover lid 2 and the weight of oxygen masks lying on the upper surface 2*b* of the cover lid 2 applies a torque onto the latch 10 around the axis 20. This torque results in a swivel movement of the latch 10 from the first locking position in FIG. 1 to the second unlocking position as shown in FIG. 2, corresponding to a release position of the latch 10 and lever 14. In the course of this movement of the latch 10 from the locking position to the unlocking position the form-locking effect between the projection 2*a* of the cover lid 2 and the recess 13 of the latch 10 is eliminated and the cover lid 2 may open by a movement like a swivel movement or a translational movement to allow the oxygen masks to drop out of their position inside a container which is closed by said cover lid 2. This condition is shown in FIG. 2. It is to be understood that the current supplied to the solenoid may only be a short peak current since as soon as a distance between the permanent magnet 40 and the metal plate 16 is present the permanent magnet 40 will no longer induce a holding force sufficient to hold the latch in the position shown in FIG. 1.

A switch 32 is arranged at the end of the pathway 31 opposed to the permanent magnet 40. Said switch 32 is activated by the end 15 of the lever 14 and is coupled to the control unit (not shown) to interrupt the supply of current to the solenoid 41 if the switch is activated. By this, the time interval of supply of current to the solenoid is minimized to a short-time period sufficient to ensure a safe release of the cover lid 2.

Figure 3:
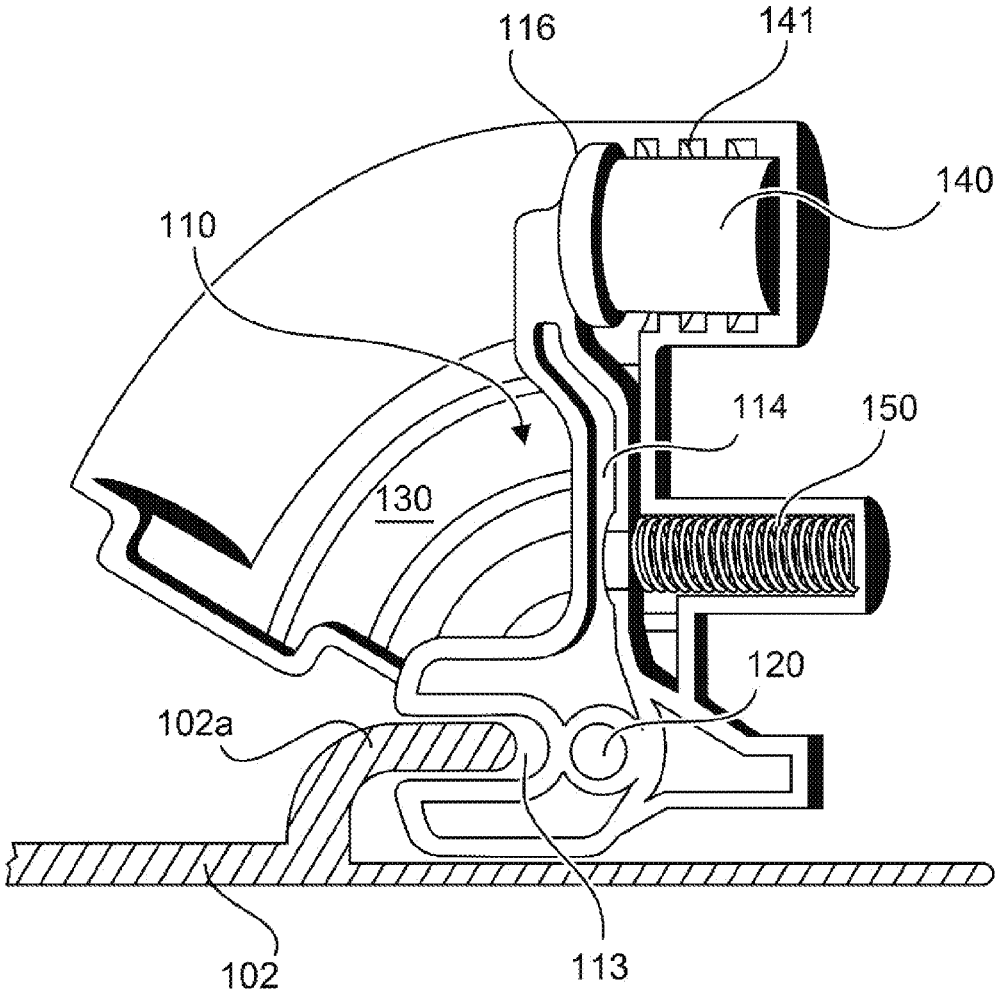
FIG. 3 shows a view according to FIG. 1 of a second embodiment of the invention.

FIG. 3 shows a second embodiment of the invention. In this embodiment a latch 110 which is hold by a permanent magnet 140 with solenoid 141 in a first locking position to hold a cover lid 102 is shown, the characteristics of this latch mechanism being identical with the characteristics of the latch mechanism described beforehand with reference to FIGS. 1 and 2.

Corresponding elements in FIG. 3 are numbered under addition of 100 to the reference number in FIG. 1, including: a projection 102*a* of the cover lid 102, an axis 120, and a recess 113. The latch mechanism shown in FIG. 3 differs from the embodiment shown in FIGS. 1, 2 in such a way that a coil spring 150 is provided which is arranged in a recess integral with the frame 130. The coil spring 25 applies a compressive force onto the lever 114 of the latch 110. Said compressive force acts against the holding force applied by the permanent magnet 140 onto the metal plate 116 of the latch 110. By this compressive force the swivel movement of the latch after supply of current to the solenoid 141 is supported and forced resulting in a quick release action of the cover lid after current supply to the solenoid 141. Thus, the embodiment shown in FIG. 3 will provide a quicker release and is less prone to be blocked by deformations or any further impacts onto the projection of the cover lid or the latch mechanism resulting from any outer influence which may occur in an emergency situation.

Figure 6:
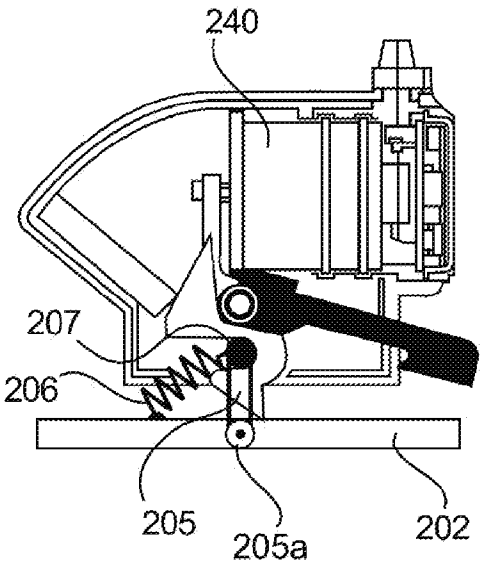
FIG. 4-6 show a view according to FIG. 1 of a third embodiment of the invention in a sequence from an open to a closed position of the cover lid.
Figure 5:
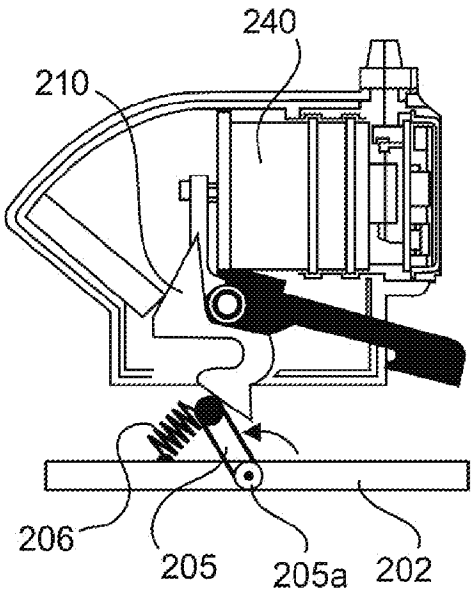
Figure 4:
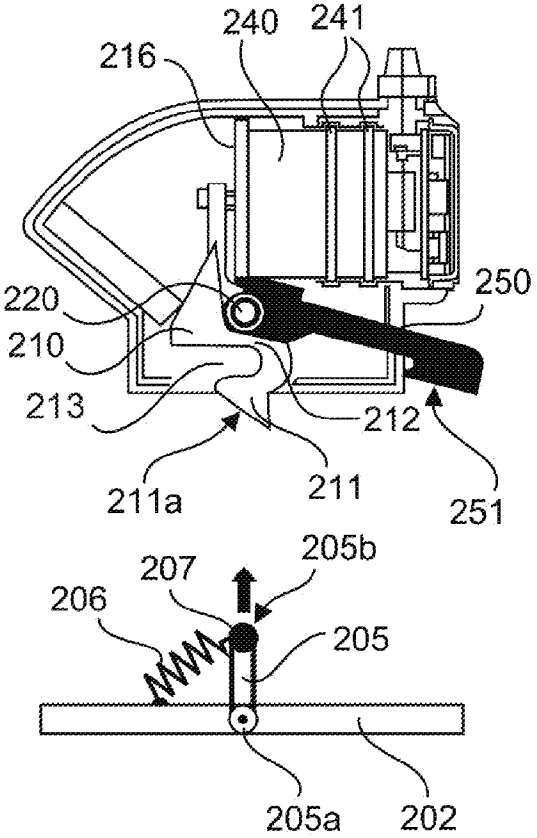

FIGS. 4-6 show a second embodiment of a latch mechanism according to the invention. Like the first and second embodiment this third embodiment comprises a permanent magnet 240 holding a metal plate 216 which is connected to a latch 210. As can be seen, the latch 210 is pivoted around an axis 220 to pivot between a first locking position and a second unlocking position.

The movement between said first locking position and said second unlocking position is actuated by the permanent magnet 240 and a solenoid 241 wound around said permanent magnet. It is to be noted that FIGS. 4-6 show said latch 210 in the first locking position only.

The third embodiment shown in FIGS. 4-6 differ from the first and the second embodiment by an indicator lever 250. Said indicator lever 250 is pivoted around axis 220 and comprises an indicator face 251 at an end opposite to the axis 220. If the latch 210 moves from the first locking position to the second unlocking position this will effect a counter-clockwise rotation of the indicator lever 250 thus lifting the indicator face 251 to a raised position. By this, it can be seen from outside whether said indicator face 251 is in the down position or the raised position indicating the latch 210 to be in the first locking position or the second unlocking position, respectively.

A further difference between the first and second embodiment and this third embodiment lies in the geometry of the latch in the region of the legs 211, 212 and the recess 213 acting to hold the cover lid 202. As can be seen from the figures, the lower leg 211 has a bottom face 211*a* which is oriented oblique to the direction of movement of the cover lid. This sloping face 211*a* provides a wedge-like effect onto a locking lever 205 which is coupled to the cover 202.

Said locking lever 205 is pivoted around an axis 205*a* and coupled via this axis 205*a* to the cover lid 202. A compressive spring 206 is provided pushing said locking lever 205 into the upright position shown in FIGS. 4 and 6. If the cover lid is raised from the open position shown in FIG. 4 the upper end 205*b* of the locking lever 205 comes into contact with the wedge-shaped face 211*a* of the latch 210. By this, the locking lever 205 is rotated counter-clockwise as shown in FIG. 5. When further lifting the cover lid 202 a locking bolt 207 at the upper end of the locking lever 205 moves into the recess 213 by a reverse movement in a clockwise direction of the locking lever 205. This reverse movement is pushed by the compressive spring 206.

As can be seen the third embodiment allows closing of the cover lid even if the latch is in the first locking position by said particular pivotal movement of the locking lever 205.

Figure 7:
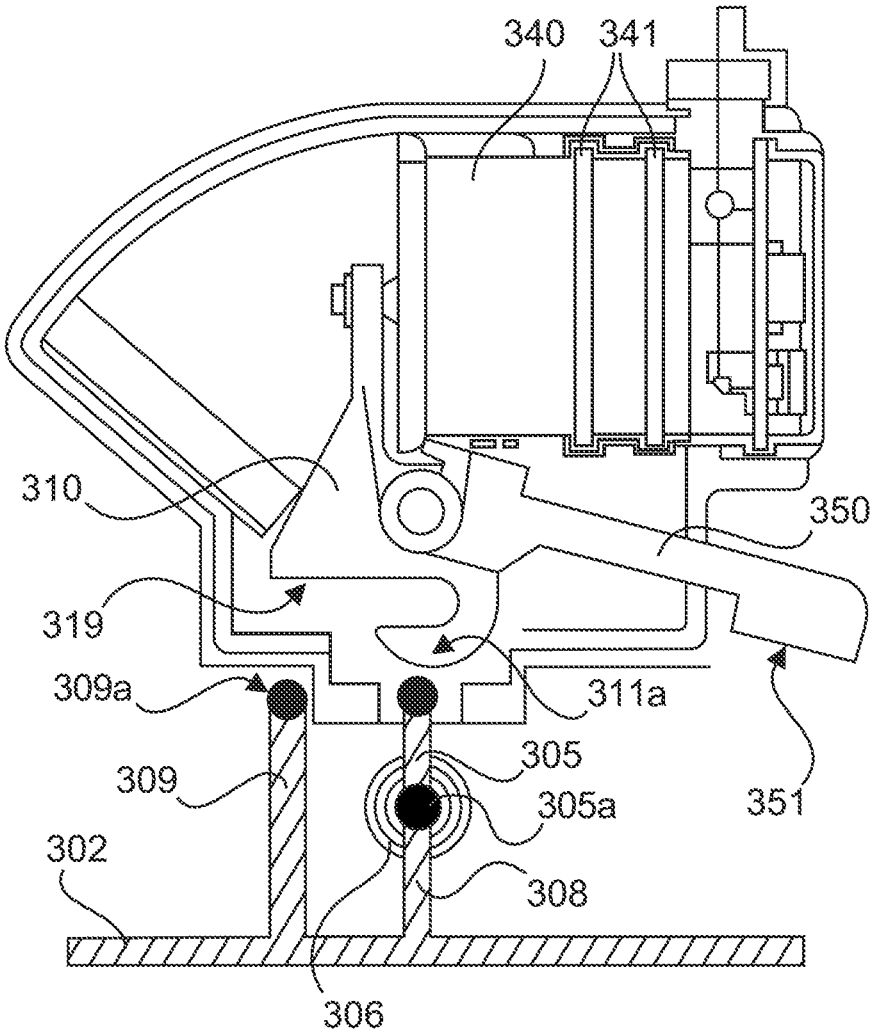
FIG. 7 shows a view according to FIG. 1 of a fourth embodiment of the invention.

FIG. 7 shows a fourth embodiment which is further equipped with a reset pin when compared to the third embodiment shown in FIGS. 4-6. As can be seen, the fourth embodiment is similar to the third embodiment with two particular exceptions.

Corresponding elements in FIG. 7 are numbered under addition of 300 to the reference number in FIG. 1, including: an axis 305*a* of the cover lid 302, a bottom face 311*a* of the lower leg 311, an indicator face 351, an indicator lever 350, a permanent magnet 340, and a solenoid 341. A first difference lies in the design of the locking lever. The fourth embodiment comprises a locking lever 305 which is pivotally mounted to a projection 308 which is integral with the cover lid 302. A spiral spring 306 is arranged around said pivotal coupling to force said locking lever 305 in a clockwise direction. The arrangement and functionality of the locking lever 305, the spiral spring 306 and the pivotal movement of said locking lever 305 allows a functionality of closing the cover lid 302 if the latch 310 is in the first, locking position in the same way like the third embodiment.

A second difference of the fourth embodiment is a reset pin 309 which is connected to the cover lid 302. The reset pin 309 extends from the cover lid 302 in the direction towards the latch 310. An upper end 309*a* of the reset pin 309 is arranged opposite to a reset face 319 of the latch 310. The upper end 309*a* of the reset pin 309 comes into contact with said reset face 319 of the latch if the latch is in the second unlocking position and the cover lid 302 is pushed into the closed position. This contact between the upper end 309*a* and the reset face 319 applies a force onto the latch 310 which effects a rotation of said latch 310 in a clockwise direction. By this, the reset pin 309 moves the latch 310 from the second unlocking position into the first locking position if the cover lid 302 is moved from the open position into a closed position.

The fourth embodiment therefore allows to close the cover lid 302 and lock the cover lid 302 in the closed position even if initially the latch 310 is in the second unlocking position.

The invention claimed is:

1. An emergency oxygen supply device for aircraft inhabitants, comprising:

an oxygen source, an oxygen mask connected via an oxygen line to said oxygen source, a container, wherein said oxygen mask is positioned inside said container, a releasable cover lid mounted to the container to close an opening of said container in a closed position of said cover lid and to open said opening in an open position, a latch mechanism mounted to said container, said latch mechanism comprising a latch which is switchable from a blocking position wherein said latch holds said cover lid in the closed position to a release position wherein said latch frees the cover lid to move into the open position, wherein the latch mechanically obstructs the cover lid in the blocking position and does not mechanically obstruct the cover lid in the open position, wherein said latch mechanism comprises a permanent magnet interacting with a magnetisable element and exerting a magnetic holding force onto said magnetisable element to hold said latch in the blocking position, wherein a solenoid is positioned adjacent to the permanent magnet, said solenoid being connected to a control unit, said control unit being adapted to receive an opening signal and to provide a current flowing through said solenoid in response to said opening signal, wherein said solenoid is arranged and dimensioned such that the current flowing through said solenoid reduces said magnetic holding force to such a level that the latch is released from the blocking position into the release position, wherein the latch further comprises a locking element with two legs which define a recess, a lower leg of the two legs having a bottom face which is oriented oblique to a direction of movement of the cover lid for providing a wedge-like effect onto a locking lever, wherein the locking lever is pivotally mounted in a pivotal coupling to a projection that is integral with the cover lid, a spring being arranged around said pivotal coupling to force said locking lever in a clockwise or counterclockwise direction, and further comprising a reset pin which is connected to the cover lid and extends from the cover lid toward the latch, an upper end of the reset pin being arranged opposite a reset face of the latch, wherein the reset pin is arranged to come into contact with said reset face of the latch when the latch is in the release position the cover lid and is moved from the open position into the closed position, such that the latch moves from the release position to the blocking position when the cover lid is moved from the open position to the closed position.

2. The emergency oxygen supply device of claim 1, wherein said permanent magnet and said solenoid are fixed to a wall of said container and said magnetisable element is fixed to said latch.

3. The emergency oxygen supply device of claim 1, wherein said latch is mounted swivelable to said container.

4. The emergency oxygen supply device of claim 1, wherein said recess is positioned such that an opening force is applied to said latch by a force of gravity on the cover lid, the opening force tending to force said latch into the release position when the latch is in the closed position, wherein said holding force holds the latch in said blocking position against said force of gravity.

5. The emergency oxygen supply device of claim 1, wherein said latch comprises a lever and said magnetisable element is mounted to said lever, wherein said blocking position and said release position of the latch correspond to a blocking position and a release position of said lever, respectively.

6. The emergency oxygen supply device of claim 5, wherein said latch mechanism comprises a spring exerting a spring force onto the lever forcing said lever into the release position, wherein said holding force holds the latch in said blocking position against said spring force.

7. The emergency oxygen supply device of claim 1, further comprising:

a switch which is actuated by the cover lid in the open position or by the latch in the release position, wherein said switch interrupts the current flow through said solenoid if said switch is actuated.

8. A method of providing oxygen to passenger of an aircraft, the method comprising:

storing an oxygen mask in a container above a passenger seat, said container comprising a cover lid holding said oxygen mask in said container when the cover lid is in a closed position, wherein said cover lid is held in said closed position by a latch in a blocking position, wherein the latch mechanically obstructs the cover lid when the latch is in the blocking position, and releasing said oxygen mask out of said container by moving said latch in a release position, whereby said cover lid is no longer mechanically obstructed by the latch, such that the cover lid moves from the closed position into an open position, wherein said latch is held in said blocking position by a holding force exerted by a permanent magnet to a magnetisable element mounted to said latch and said latch is moved from the blocking position into the release position by supplying a current to a solenoid and thereby reducing or eliminating the holding force of said permanent magnet, wherein the latch comprises a locking element having two legs that define a recess, a lower leg of the two legs having a bottom face which is oriented oblique to a direction of movement of the cover lid for providing a wedge-like effect onto a locking lever, wherein the locking lever is pivotally mounted at a pivotal coupling to a projection which is integral with the cover lid, and a spring is arranged around said pivotal coupling to force said locking lever in a clockwise or counterclockwise direction, and wherein a reset pin is connected to the cover lid and extends from the cover lid toward the latch, an upper end of the reset pin being arranged opposite a reset face of the latch for coming into contact with said reset face of the latch when the latch is in the release position and the cover lid is pushed into the closed position, such that the latch moves from the release position into the blocking position when the cover lid is moved from the open position to the closed position.

9. The emergency oxygen supply device of claim 1, wherein the latch mechanically interfaces with the cover lid to lock the cover lid in the closed position.

10. The emergency oxygen supply device of claim 1, wherein the latch mechanically interfaces with the projection of the cover lid in the closed position.

11. The emergency oxygen supply device of claim 1, wherein the latch being switchable from a blocking position to a release position comprises the latch being movable between a first locking position and a second unlocking position.

* * * * *